US008045743B2

(12) United States Patent
Aylward et al.

(10) Patent No.: US 8,045,743 B2
(45) **Date of Patent: *Oct. 25, 2011**

(54) SEAT ELECTROACOUSTICAL TRANSDUCING

(75) Inventors: J. Richard Aylward, Ashland, MA (US); Charles R. Barker, III, Framingham, MA (US)

(73) Assignee: Bose Corporation, Framingham, MA (US)

( * ) Notice: Subject to any disclaimer, the term of this patent is extended or adjusted under 35 U.S.C. 154(b) by 206 days.

This patent is subject to a terminal disclaimer.

(21) Appl. No.: 12/510,429

(22) Filed: Jul. 28, 2009

(65) Prior Publication Data

US 2009/0284055 A1 Nov. 19, 2009

Related U.S. Application Data

(63) Continuation of application No. 11/224,886, filed on Sep. 12, 2005, now Pat. No. 7,688,992.

(51) Int. Cl.
*H04R 1/02* (2006.01)

(52) U.S. Cl. ..... 381/388; 381/386; 381/389

(58) Field of Classification Search ..... 181/151, 181/171, 199; 381/86, 151, 301, 302, 333, 381/336, 365, 374, 386, 388, 389
See application file for complete search history.

(56) References Cited

U.S. PATENT DOCUMENTS

| | | | |
|---|---|---|---|
| 2,203,715 | A | 6/1940 | Benecke |
| 3,976,162 | A | 8/1976 | Cummings |
| 4,031,321 | A | 6/1977 | Bakgaard |
| 4,042,791 | A | 8/1977 | Wiseman |
| 4,146,744 | A | 3/1979 | Veranth |
| 4,146,745 | A | 3/1979 | Froeschle et al. |
| 4,199,658 | A | 4/1980 | Iwahara |
| 4,210,784 | A | 7/1980 | Phillips |
| 4,569,074 | A | 2/1986 | Polk |
| 4,653,606 | A | 3/1987 | Flanagan |
| 4,739,514 | A | 4/1988 | Short et al. |
| 4,797,934 | A | 1/1989 | Hufnagel |
| 4,924,962 | A | 5/1990 | Terai et al. |
| 4,944,018 | A | 7/1990 | Bose et al. |
| 5,031,220 | A | 7/1991 | Takagi et al. |

(Continued)

FOREIGN PATENT DOCUMENTS

DE 4419079 C1 11/1995

(Continued)

OTHER PUBLICATIONS

Extended Search Report dated Jan. 16, 2008 for EP 06120227.1.

(Continued)

*Primary Examiner* — Brian Ensey

(57) ABSTRACT

An acoustic device, including an acoustic enclosure and a first electroacoustical transducing apparatus comprising a motor structure providing mechanical vibration, the vibration having a direction of vibration, mounted in the acoustic enclosure. The acoustic device is constructed and arranged so that first pressure waves are radiated from a first radiation point and second pressure waves are radiated from a second radiation point and so that the first pressure waves and the second pressure waves destructively interfere at observation points relatively equidistant from the first and second radiation points. The acoustic device is further constructed and arranged to be structurally combined with a seating device so that the first radiation point is relatively close to the head of an occupant of the seating device and so that the second radiation point is relatively far from the head of the occupant. The acoustic device is further constructed and arranged to transmit the mechanical vibration to the seat back.

17 Claims, 13 Drawing Sheets

U.S. PATENT DOCUMENTS

| | | | | |
|---|---|---|---|---|
| 5,046,097 | A | 9/1991 | Lowe et al. | |
| 5,129,004 | A | 7/1992 | Imai et al. | |
| 5,131,051 | A | 7/1992 | Kishinaga et al. | |
| 5,146,507 | A | 9/1992 | Satoh et al. | |
| 5,228,085 | A | 7/1993 | Aylward | |
| 5,333,200 | A | 7/1994 | Cooper et al. | |
| 5,398,992 | A | 3/1995 | Daniels | |
| 5,428,687 | A | 6/1995 | Willcocks et al. | |
| 5,434,922 | A | 7/1995 | Miller et al. | |
| 5,588,063 | A | 12/1996 | Edgar | |
| 5,621,804 | A | 4/1997 | Beppu | |
| 5,666,424 | A | 9/1997 | Fosgate et al. | |
| 5,754,664 | A | 5/1998 | Clark et al. | |
| 5,764,777 | A | 6/1998 | Goldfarb | |
| 5,784,471 | A | 7/1998 | Bebenroth | |
| 5,809,153 | A | 9/1998 | Aylward et al. | |
| 5,815,580 | A | 9/1998 | Craven et al. | |
| 5,821,471 | A | 10/1998 | McCuller | |
| 5,844,176 | A | 12/1998 | Clark | |
| 5,870,484 | A | 2/1999 | Greenberger | |
| 5,887,071 | A | 3/1999 | House | |
| 5,889,875 | A | 3/1999 | Caron et al. | |
| 5,946,401 | A | 8/1999 | Ferren | |
| 5,949,894 | A | 9/1999 | Nelson et al. | |
| 5,988,314 | A | 11/1999 | Negishi | |
| 5,995,631 | A | 11/1999 | Kamada et al. | |
| 6,067,360 | A | 5/2000 | Kasai et al. | |
| 6,118,883 | A | 9/2000 | Rocha | |
| 6,154,545 | A | 11/2000 | Kohut et al. | |
| 6,154,549 | A | 11/2000 | Arnold et al. | |
| 6,172,641 | B1 | 1/2001 | Millington | |
| 6,198,827 | B1 | 3/2001 | Waller, Jr. | |
| 6,643,375 | B1 | 11/2003 | Philp et al. | |
| 6,681,024 | B2 | 1/2004 | Klein et al. | |
| 6,711,266 | B1 | 3/2004 | Aylward | |
| 6,853,732 | B2 | 2/2005 | Scofield | |
| 7,092,531 | B2 | 8/2006 | Enya et al. | |
| 7,164,768 | B2 | 1/2007 | Aylward et al. | |
| 7,164,773 | B2 | 1/2007 | Fabry | |
| 7,440,578 | B2 | 10/2008 | Arai et al. | |
| 7,483,540 | B2 | 1/2009 | Rabinowitz et al. | |
| 7,519,188 | B2 | 4/2009 | Berardi et al. | |
| 7,545,946 | B2 | 6/2009 | Melanson | |
| 2002/0150254 | A1 | 10/2002 | Wilcock et al. | |
| 2003/0103636 | A1 | 6/2003 | Arai et al. | |
| 2003/0152245 | A1 | 8/2003 | Maekawa et al. | |
| 2004/0105550 | A1 | 6/2004 | Aylward et al. | |
| 2004/0105559 | A1 | 6/2004 | Aylward et al. | |
| 2004/0196982 | A1 | 10/2004 | Aylward et al. | |
| 2005/0117767 | A1 * | 6/2005 | Ito et al. | 381/333 |
| 2005/0128106 | A1 | 6/2005 | Nakaishi et al. | |
| 2005/0152562 | A1 | 7/2005 | Holmi et al. | |
| 2005/0259831 | A1 | 11/2005 | Hutt et al. | |
| 2005/0270146 | A1 | 12/2005 | Enya et al. | |
| 2006/0262935 | A1 | 11/2006 | Goose et al. | |
| 2007/0058824 | A1 | 3/2007 | Aylward et al. | |
| 2007/0098205 | A1 | 5/2007 | Holmi et al. | |
| 2007/0116298 | A1 | 5/2007 | Holmi et al. | |
| 2008/0273713 | A1 | 11/2008 | Hartung et al. | |
| 2008/0273714 | A1 | 11/2008 | Hartung | |
| 2008/0273723 | A1 | 11/2008 | Hartung et al. | |
| 2008/0273724 | A1 | 11/2008 | Hartung et al. | |

FOREIGN PATENT DOCUMENTS

| | | | |
|---|---|---|---|
| DE | 19938171 | A1 | 3/2001 |
| DE | 10345679 | A1 | 5/2005 |
| EP | 0637191 | A2 | 2/1995 |
| EP | 0809413 | A1 | 11/1997 |
| EP | 1052877 | A2 | 11/2000 |
| EP | 1370115 | A2 | 12/2003 |
| EP | 1427253 | A2 | 6/2004 |
| EP | 1475996 | A1 | 11/2004 |
| EP | 1596627 | A2 | 11/2005 |
| EP | 1763281 | A2 | 3/2007 |
| EP | 1788838 | | 5/2007 |
| FR | 2768099 | A1 | 3/1999 |
| FR | 2768100 | A1 | 3/1999 |
| FR | 2779313 | A1 | 12/1999 |
| FR | 2841728 | A1 | 1/2004 |
| JP | 56-047197 | A | 4/1981 |
| JP | 61-127299 | A | 6/1986 |
| JP | 64-078600 | | 3/1989 |
| JP | 1151397 | A | 6/1989 |
| JP | 02-007699 | A | 1/1990 |
| JP | 03085096 | A | 4/1991 |
| JP | 04-137897 | A | 5/1992 |
| JP | 05-191342 | A | 7/1993 |
| JP | 07-264689 | A | 10/1995 |
| JP | 09-070100 | | 3/1997 |
| JP | 09252499 | A | 9/1997 |
| JP | 2002159082 | A | 5/2002 |
| JP | 2002354567 | A | 12/2002 |
| JP | 2005223630 | A | 8/2005 |
| JP | 2006222686 | A | 8/2006 |
| WO | 93/14606 | A1 | 7/1993 |
| WO | 96/33591 | A1 | 10/1996 |
| WO | 99/48327 | A1 | 9/1999 |
| WO | 00/19415 | | 4/2000 |
| WO | 01/15489 | A2 | 3/2001 |
| WO | 02/065815 | A2 | 8/2002 |
| WO | 03/001885 | A2 | 1/2003 |
| WO | 2004049755 | A1 | 6/2004 |
| WO | 2005004537 | A2 | 1/2005 |
| WO | 2005115050 | A1 | 12/2005 |
| WO | 2007016527 | A1 | 2/2007 |

OTHER PUBLICATIONS

EP Office Action dated Jun. 4, 2010 for EP Appln. No. 08782152.6.
EP Notice of Allowance dated Apr. 24, 2009 for EP 06120227.1.
EP Notice of Grant dated Oct. 15, 2009 for EP 06120227.1.
ISR/WO in Appl. No. PCT/US2008/060190, dated Jul. 30, 2008.
International Search Report and Written Opinion dated Sep. 29, 2008 for PCT/US08/059994.
International Preliminary Report on Patentability dated Aug. 17, 2009 for PCT/US2008/060190.
Elliot, S.J. "Signal Processing for Active Control," Academic Press, 2001. pp. 151-200.
PCT search report and written opinion for PCT/US2008/070672 corresponding to U.S. Appl. No. 11/780,468 dated Feb. 6, 2009.
PCT search report and written opinion for corresponding app. No. PCT/US2008/070673, dated Oct. 21, 2008.
PCT search report and written opinion for PCT/US2008/070680, corresponding to U.S. Appl. No. 11/780,463, dated Feb. 11, 2009.
PCT search report and written opinion for PCT/US2008/070675 corresponding to U.S. Appl. No. 11/780,461, dated Oct. 21, 2008.
PCT search report and written opinion for PCT/US2008/070678, corresponding to U.S. Appl. No. 11/780,464, dated Jan. 12, 2009.
International Preliminary Report on Patentability for PCT/US2008/059994 dated Aug. 17, 2009.
European Office Action for application No. 0879386.4, corresponding to U.S. published No. 2008/0273723 dated Aug. 23, 2010.
CN Office Action dated Nov. 24, 2010 for CN Appln. No. 200610153637.X.

* cited by examiner

SEAT ELECTROACOUSTICAL TRANSDUCING

CLAIM OF PRIORITY

This application is a continuation of, and claims the priority of, U.S. patent application Ser. No. 11/224,886, filed Sep. 12, 2005, which is incorporated by reference herein in its entirety.

BACKGROUND

This specification describes a loudspeaker system including a dipole bass loudspeaker mounted in a seating device.

SUMMARY

In one aspect of the invention, an acoustic device, includes an acoustic enclosure; a first electroacoustical transducing apparatus that includes a motor structure providing mechanical vibration having a direction of vibration. The transducing apparatus is mounted in the acoustic enclosure. The acoustic device is constructed and arranged so that first pressure waves are radiated from a first radiation point and second pressure waves are radiated from a second radiation point and so that the first pressure waves and the second pressure waves destructively interfere at observation points relatively equidistant from the first and second radiation points. The acoustic device is further constructed and arranged to be structurally combined with a seating device so that the first radiation point is relatively close to the head of an occupant of the seating device and so that the second radiation point is relatively far from the head of the occupant. The acoustic device is still further constructed and arranged to transmit the mechanical vibration to the seat back. The device may be further constructed and arranged to emit a tactilely discernible pressure impulse from the first radiation point. The apparatus may be constructed and arranged to inject an aroma into the pressure wave. The electroacoustical transducing apparatus may include a vibratile diaphragm having a first radiating surface and an opposed second radiating surface. The acoustic enclosure may include a first chamber acoustically coupling the first radiating surface with the first radiation point. The electroacoustical transducing apparatus may further include a second chamber acoustically coupling the second radiating surface with the second radiation point. The second radiation point may constructed and arranged to be below the head of an occupant of the seating device. The second radiation point may positioned near the bottom of the seat back. The first radiation point may be proximate the back of the neck of an occupant of the seating device. The first transducing apparatus may be communicatingly coupled to an audio signal source and positioned adjacent the first radiation point to radiate the first pressure waves, and the acoustic device may further include a second transducing apparatus communicatingly coupled to the audio signal source with reversed polarity relative to the first transducer, positioned adjacent the second radiation point to radiate the second pressure waves. The apparatus may be further constructed and arrange to provide an aroma to the occupant. The first transducing apparatus may be constructed and arranged to radiate first pressure waves in the bass frequency range and the apparatus may further include a directional loudspeaker, constructed and arranged to radiate sound in a non-bass frequency range. The loudspeaker may constructed and arranged to radiate bass frequencies and to not radiate frequencies and wherein the directional loudspeaker is constructed and arranged to radiate frequencies above the bass frequency range. The first electroacoustical transducing apparatus may be constructed and arranged to radiate bass frequencies and to not radiate frequencies above the bass frequency range.

In another aspect of the invention, an apparatus includes a seating device including a seat back and a transducer constructed and arranged to be structurally combined with the seating device. The transducer includes a linear motor. The linear motor is mechanically coupled to a pressure wave radiating diaphragm having a first surface and a second surface to radiate acoustic energy and also mechanically coupled to the seat back to transmit mechanical vibration of the linear motor to the seat back. The linear motor may be further mechanically coupled to the pressure wave radiating surface to emit a tactilely perceivable puff of air to the vicinity of the neck of an occupant of the seat. The device may further include an acoustic enclosure having a first radiation point and a second radiation point. The transducer may be mounted in the acoustic enclosure so that pressure waves radiated by a first diaphragm surface leave the enclosure through the first radiation point and so that the pressure waves radiated by a second diaphragm surface leave the enclosure through the second radiation point. The seating device may further include a directional loudspeaker, constructed and arranged to radiate sound so that the direction typically occupied by the head of an occupant of the seat is a high radiation direction. The transducer may be constructed and arranged to radiate bass frequencies and to not radiate frequencies above the bass frequency range and the directional loudspeaker may be constructed and arranged to radiate frequencies above the bass frequency range.

In another aspect of the invention, an acoustic enclosure includes structure defining a first chamber and a second chamber, each having an interior and an exit point; a mounting location for an electroacoustical transducer having a diaphragm having a first radiating surface and a second radiating surface. The mounting location is configured so that the first radiating surface of a transducer mounted in the mounting location faces the first chamber interior and the second radiating surface faces the second chamber interior. The acoustic enclosure is constructed and arranged to be mountable to a seat having a seat back so that the first chamber exit point is near the head location of a person seated in the seat, so that the second chamber exit is distant from the head location of a person seated in the seat, and so that mechanical vibration generated by a transducer mounted in the mounting location is mechanically transmitted to the seat back. The transducer may be constructed and arranged to radiate pressure waves in a first spectral band. The enclosure may further include a directional loudspeaker, constructed and arranged to radiate pressure waves in a second spectral band. The first spectral band may include bass frequencies and the second spectral band may include frequencies above the bass frequencies. The electroacoustical transducing apparatus may be constructed and arranged to radiate bass frequencies and to not radiate frequencies above the bass frequency range.

In another aspect of the invention, an apparatus includes a seat includes a seat back. A transducer is mounted to the seat back. The transducer may include a linear motor. The transducer is mounted in an acoustic enclosure having an exit and includes a pressure wave radiating diaphragm coupled to the linear motor. The diaphragm has a first surface and a second surface to radiate acoustic energy. The transducer is constructed and arranged to emit a tactilely discernible pressure impulse from the exit. The exit may be proximate the position of back of the neck of an occupant of the seat.

In still another aspect of the invention, a method for operating a seat mounted loudspeaker device includes radiating, by a transducer, first audible pressure waves from a first radiation point; radiating, by the transducer, a pressure impulse tactilely perceivable by an occupant of the chair; and transmitting mechanical vibration from the transducer to the back of the seat. The method may further include radiating second pressure waves from a second radiation point so that the second pressure waves destructively interfere with the first pressure waves at locations that are substantially equidistant from the first radiation point and the second radiation point. The method may further include emitting an aroma from the first radiation point.

Other features, objects, and advantages will become apparent from the following detailed description, when read in connection with the following drawing, in which:

DETAILED DESCRIPTION

Figure 1:
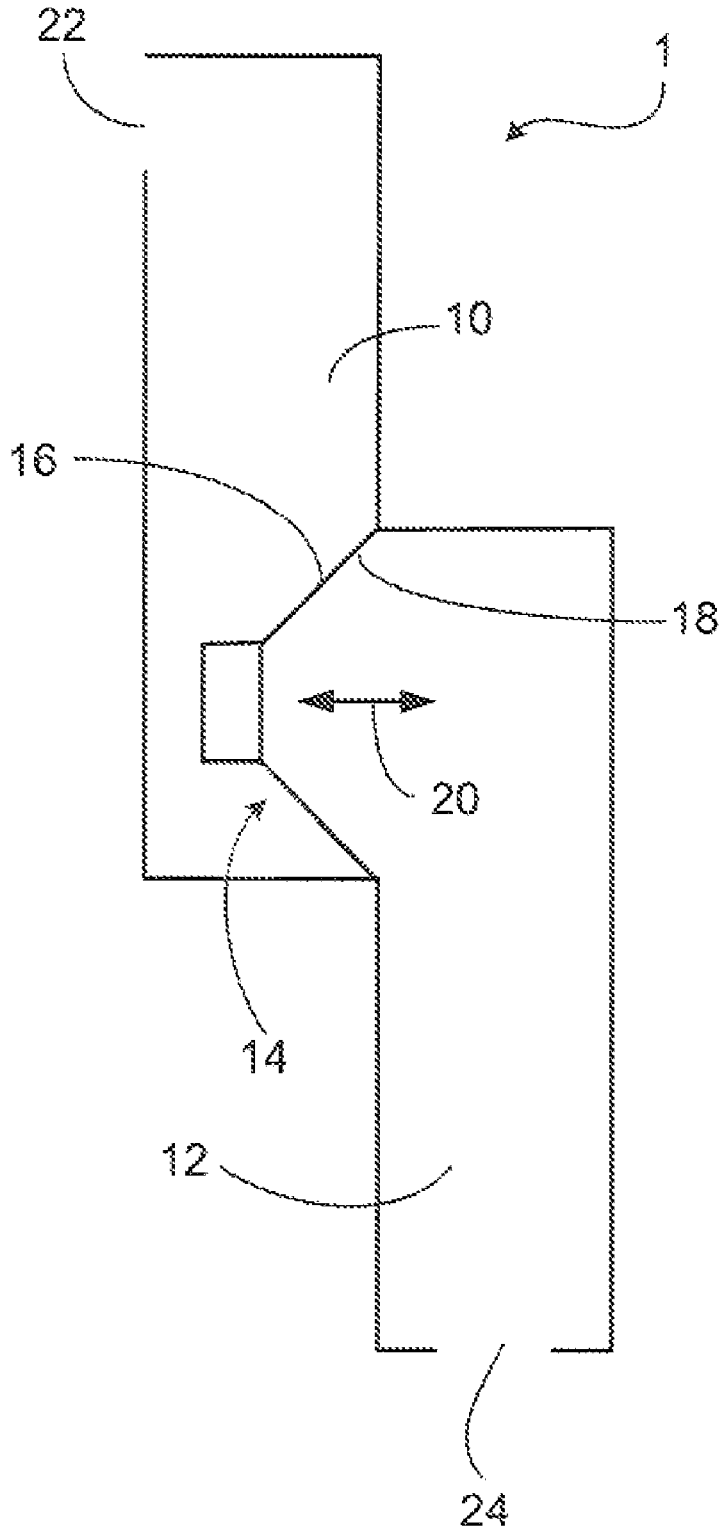
FIG. 1 is a diagrammatic view of a bass loudspeaker device.

Though the elements of several views of the drawing may be shown and described as discrete elements in a block diagram and are referred to as "circuitry", unless otherwise indicated, the elements may be implemented as one of, or a combination of, analog circuitry, digital circuitry, or one or more microprocessors executing software instructions. The software instructions may include digital signal processing (DSP) instructions. Unless otherwise indicated, signal lines may be implemented as discrete analog or digital signal lines, as a single discrete digital signal line with appropriate signal processing to process separate streams of audio signals, or as elements of a wireless communication system. Some of the processing operations are expressed in terms of the calculation and application of coefficients. The equivalent of calculating and applying coefficients can be performed by other signal processing techniques and are included within the scope of this patent application. Unless otherwise indicated, audio signals may be encoded in either digital or analog form. For simplicity of wording "radiating acoustic energy corresponding to audio signal x" will be referred to as "radiating signal x." The specification also discusses directional loudspeakers, and more specifically directional arrays. Directional arrays are directional loudspeakers that have multiple acoustic energy sources. In a directional array, over a range of frequencies in which the corresponding wavelengths are large relative to the spacing of the energy sources, the pressure waves radiated by the acoustic energy sources destructively interfere, so that the array radiates more or less energy in different directions depending on the degree of destructive interference that occurs. The directions in which relatively more acoustic energy is radiated, for example directions in which the sound pressure level is within −6 dB (preferably between −6 dB and −4 dB and ideally between −4 dB and −0 dB) of the maximum sound pressure level (SPL) in any direction at points of equivalent distance from the directional loudspeaker will be referred to as "high radiation directions." The directions in which less acoustic energy is radiated, for example directions in which the SPL is more than −6 dB (preferably between −6 dB and −10 dB, and ideally greater than −10 dB, for example −20 dB) relative to the maximum in any direction for points equidistant from the directional loudspeaker, will be referred to as "low radiation directions".

Referring to FIG. 1 there is shown a diagrammatic cross-sectional view of a bass loudspeaker device that can be mounted to a seating device or integrated into a seating device. Examples of seating devices may include a seat designed for use with a video game, a gaming device, or an amusement ride; a theater seat; a car or truck seat; or an easy chair for use with a multimedia home entertainment system. The device 1 includes an acoustic enclosure having an upper acoustic chamber 10 and a lower acoustic chamber 12. Upper acoustic chamber 10 and lower acoustic chamber 12 and a diaphragm type electroacoustical transducer 14 are arranged so that one radiating surface 16 of the transducer diaphragm is acoustically coupled to upper acoustic chamber 10 and a second radiating surface 18 of transducer 14 is acoustically coupled to lower acoustic chamber 12. Transducer 14 may be a cone type transducer with a linear motor structure that includes a moving structure that vibrates along an axis 20, causing the diaphragm to vibrate, radiating pressure waves into chambers 10 and 12. In one implementation, axis 20 is perpendicular to the plane of the seat back; however in other implementations, axis 20 may be parallel or at some other orientation to the plane of the seat back. Upper chamber exit 22 and lower chamber exit 24 may be approximately equidistant from the transducer 14, but are not necessarily equidistant, as will be discussed below. The ducts and the chambers may be configured so that they do not appreciably modify the low frequency acoustic energy radiated by the diaphragm. In other implementations, upper chamber exit 22 or lower chamber exit 24 or both may be configured to act as acoustic elements such as ports. In still other implementations, upper and lower chambers 10 and 12 could be some other form of acoustic device, such as a waveguide and exits 22 and 24 could be waveguide exits or could include some other form of acoustic device, such as a passive radiator.

Figure 2B:
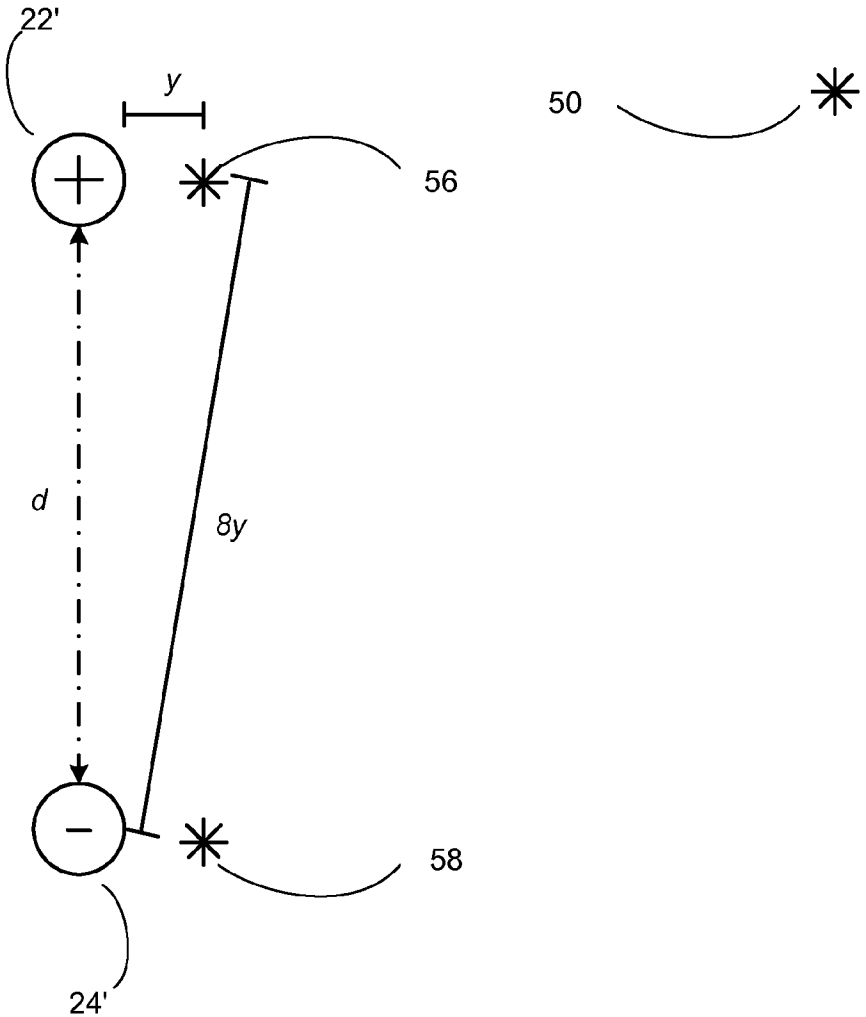
FIGS. 2A-2C are diagrammatic views illustrating the acoustic behavior of the bass loudspeaker device.
Figure 2A:
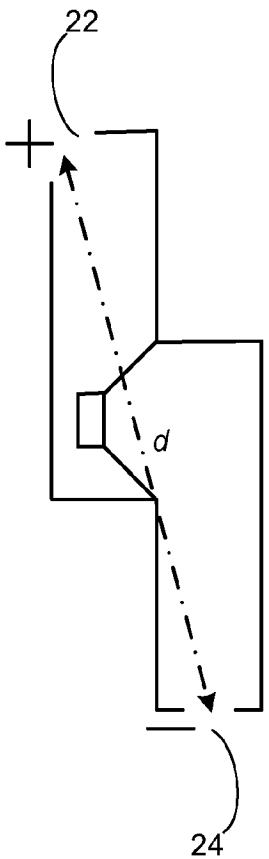

Referring to FIGS. 2A and 2B, there is shown a diagram illustrating the acoustic behavior of the device shown in FIG. 1. Exit 22 is acoustically coupled to diaphragm surface 16 and exit 24 is acoustically coupled to diaphragm surface 18. Diaphragm surfaces 16 and 18 radiate pressure waves of opposite phase. The opposite phase pressure waves are radiated through exits 22 and 24, as indicated by the "+" and "−" in FIG. 2A. Exits 22 and 24 are the points at which the pressure waves from the transducer are radiated from the loudspeaker device to the environment. The combined effect of the enclosure and the exits 22 and 24 is to cause it to appear that the points from which the acoustic energy is radiated are the two exits 22 and 24. Hereinafter, points at which pressure waves are radiated from the loudspeaker device 1 to the environment will be referred to as "radiation points." The device of FIG. 1 can thus be represented, as shown in FIG. 2B, as a dipole, that is, a pair of monopole spherical radiation points 22' and 24' separated by a distance d and driven out of phase. The pressure at an observation point is the combination of the pressure waves from the two sources. At observation points such as point 50, for which the distance from the device is similar to or large relative to distance d, the distance from the two sources to the observation point is relatively equal and the magnitude of the pressure waves from radiation points 22' and 24' are approximately equal. If the magnitudes of the acoustic energy from the two radiation points 22' and 24' are relatively equal and the audio signal radiated are highly correlated, the manner in which the contributions from the two radiation points combine is determined principally by the relative phase of the pressure waves at the observation point. At some frequencies, the pressure waves may have some phase difference and destructively interfere resulting in reduced amplitude.

At points such as points 56 and 58 that are significantly closer to one of the two radiation points, the magnitude of the pressure waves from the two radiation points are not equal, and the sound pressure level at points 56 and 58 is determined principally by the sound pressure level from radiation points 22' and 24', respectively. For example, at observation point 56, which is distance y from radiation point 22' and a much larger distance, such as 8y, from radiation point 24', the sound pressure from radiation point 24' is significantly less than the sound pressure from radiation point 22'. Therefore, sound that is heard at observation point 56 is determined principally by the pressure waves radiating from radiation point 22'.

The pressure wave radiation points 22' and 24' of FIGS. 2A and 2B can be provided by an enclosure with a transducer and two exits. Other arrangements in which pressure waves radiated from a first exit and radiation and pressure waves radiated from a second exit destructively interfere can also be modeled by the arrangement of FIGS. 2A and 2B. For example, two acoustic drivers separated by a distance d can be driven with audio signals having reversed polarity, as will be shown below in FIG. 6 and discussed in the corresponding portion of the specification.

Figure 2C:
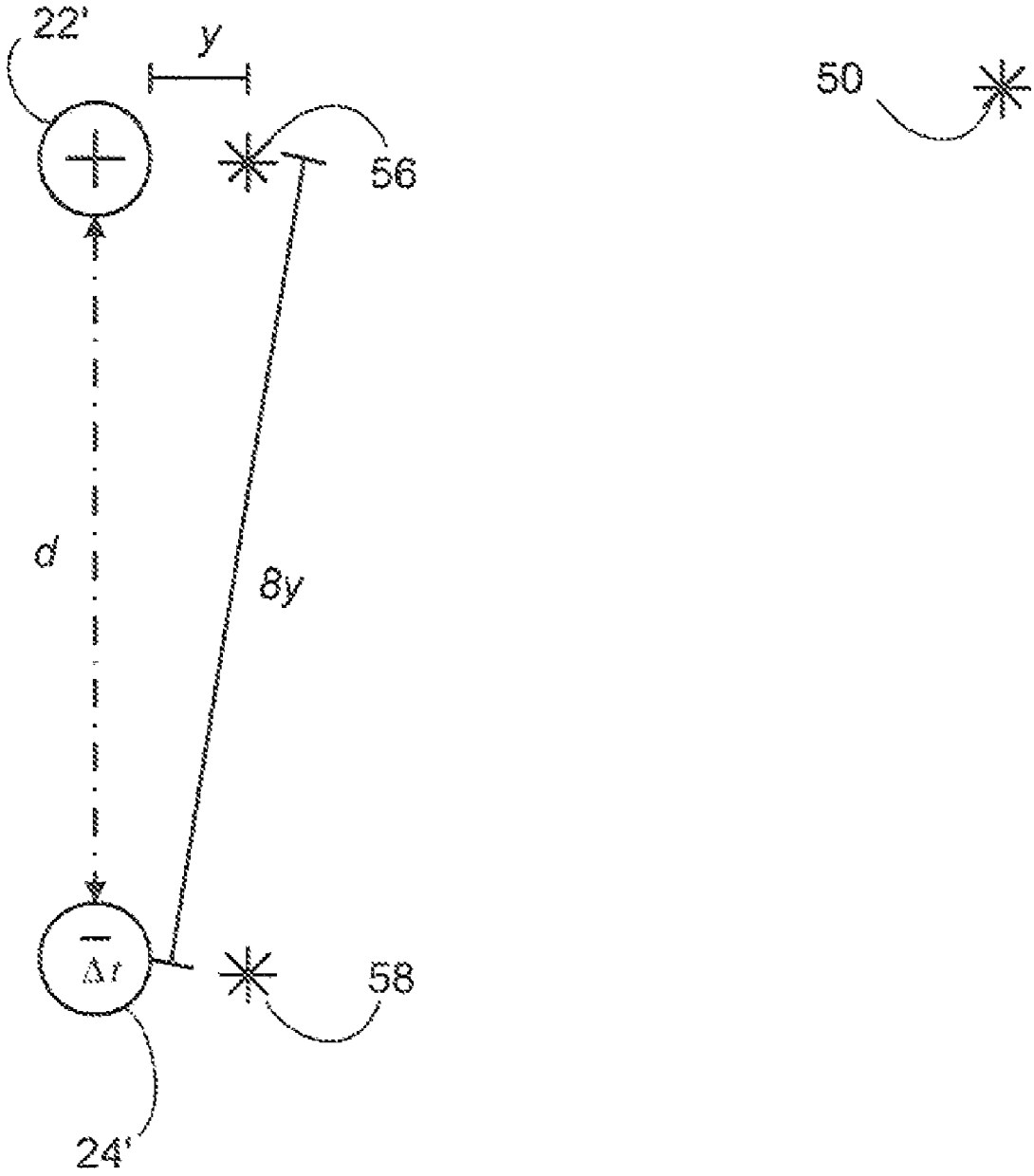

In some of the implementations shown in subsequent figures, the radiation points 22' and 24' may not be equidistant from the transducer 14, or the device may include two acoustic drivers separated by a distance d and driven with audio signals having reversed polarity with a delay applied to the signal applied to one of the acoustic drivers. In such cases, the arrangement may be modeled by the arrangement of FIG. 2C, in which a delay $\Delta t$ is applied to one of the radiation points, such as 24'. A device modeled by that arrangement of FIG. 2C may have a non-dipole radiation pattern, such as a cardioid radiation pattern. Similar to arrangements with dipole radiation patterns, the pressure at an observation point is the combination of the pressure waves from the two sources. At observation points such as point 50, for which the distance from the device is similar to or large relative to distance d, the distance from the two sources to the observation point is relatively equal and the magnitude of the pressure waves from radiation points 22' and 24' are approximately equal. If the magnitudes of the acoustic energy from the two radiation points 22' and 24' are relatively equal and the audio signal radiated are highly correlated, the manner in which the contributions from the two radiation points combine is determined principally by the relative phase of the pressure waves at the observation point. At some frequencies, the pressure waves may have some phase difference and destructively interfere resulting in reduced amplitude.

At points such as points 56 and 58 that are significantly closer to one of the two radiation points, the magnitude of the pressure waves from the two radiation points are not equal, and the sound pressure level at points 56 and 58 is determined principally by the sound pressure level from radiation points 22' and 24', respectively. For example, at observation point 56, which is distance y from radiation point 22' and a much larger distance, such as 8y, from radiation point 24', the sound pressure from radiation point 24' is significantly less than the sound pressure from radiation point 22'. Therefore, sound that is heard at observation point 56 is determined principally by the pressure waves radiating from radiation point 22'.

Figure 3:
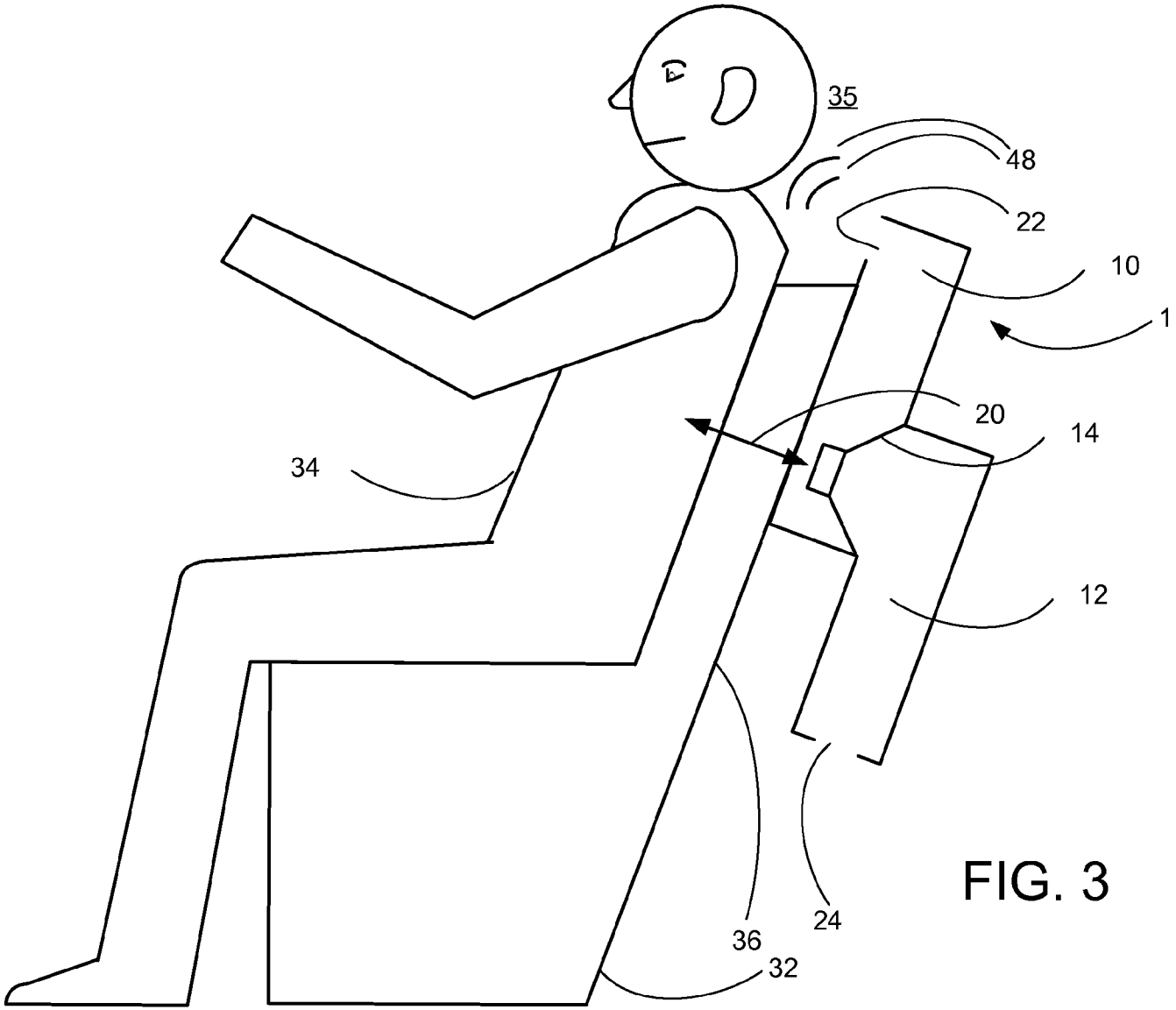
FIG. 3 is a diagrammatic view of a bass loudspeaker device mounted to a seating device.

FIG. 3 shows the device 1 mounted on a seat 32, for example a seat associated with a video game, a gaming device, an amusement ride, or a car or truck. Device 1 is mounted so that upper chamber exit 22 is near the head of a person 34 seated in the seat 32, for example near the back of the neck of person 34. Device 1 is also mounted so that lower chamber exit 24 is significantly farther from the vicinity of the head of person 34 than is the upper exit 22, for example significantly lower than exit 22 and near floor level so that exit 24 is not near the heads of occupants of nearby seats. In addition, device 1 is mounted so that vibrations of the transducer are mechanically transmitted to the seat back 36. The vibrations may be transmitted through mechanical coupling paths, or may be vibrations of the enclosure walls, excited by the pressure waves radiated by the transducer. The device 1 is mounted to seat back 36, preferably so the axis of vibration 20 is generally perpendicular to the plane of the seat back 36.

In operation, transducer 14 radiates acoustic energy into upper chamber 10 and lower chamber 12, causing pressure waves to leave the enclosure and enter the external environment through exits 22 and 24. Because the vicinity 35 near head of the seated person 34 is significantly closer to upper chamber exit 22 than to lower chamber exit 24, the sound heard by the seated person is affected much more by radiation from upper chamber exit 22 than from lower chamber exit 24. Lower chamber exit 24 is not positioned near any listening location. At locations, such as location 50 of FIG. 2 that are relatively equidistant from exits 22 and 24 the magnitudes of the acoustic energy from exits 22 and 24 are relatively equal and the net acoustic energy present at location 50 is of lesser amplitude than near the head of the seated person 34 because of destructive interference due to phase differences. The result is that there is significantly greater net acoustic energy present in the vicinity 35 near the head of the seated person 34, than there is at other positions at head level or above, so that the sound associated with the activity in which the person 34 is engaged does not audibly interfere with activities of other nearby persons.

Another feature of the device of FIGS. 1-3 and other devices described below is that the devices can provide tactile stimulation to seated person 34. In addition to radiating acoustic energy, the device of FIGS. 1-3 can radiate tactilely discernible pressure impulses or pressure waves. For example, the transducer 14 could radiate a pressure impulse that causes airflow to impinge on the seated person 34, such as a puff of air on the back of the person's neck, as represented by lines 48. Radiating a tactilely perceivable puff of air can be done by driving the transducer at frequencies below acoustically perceptible frequencies. Additionally, the vibration of the transducer 14 can be mechanically transmitted to the seat back 36, providing additional tactile stimulation, through mechanical paths joining the transducer and seat back, or by vibrations of the enclosure, excited by pressure waves radiated by the transducer. Additional sensory stimulation, such as aromas can be injected into the airflow.

The structure of FIGS. 1-3 also protects the transducer 14 from mechanical damage that may occur in heavily trafficked areas, such as gaming parlors, video game arcades, vehicle interiors and the like.

The device of FIGS. 1-3 and other devices described below can be used over the entire audible frequency range, but is most advantageously used in the bass frequency range because the dipole pattern is most effective at frequency ranges with corresponding wavelengths longer than the dimensions of the device; because the vibrations mechanically transmitted to the seat back are most discernible and effective at bass frequencies; because the amount of force necessary for the vibrations to be perceivable typically require the greater mass associated with bass range transducers; and because the amount of air movement necessary to produce a discernible air flow requires a transducer that can move the large amounts of air such as the transducers that are typically associated with bass range transducers. In one implementation, the transducer is a part number 255042 transducer, manufactured by Bose Corporation of Framingham, Mass., USA.

Though the devices described in this specification described in terms of "upper" and "lower" radiation points, the devices can be implemented in other ways. For example, the first radiation point could be near the head of a user and the second radiation point could be laterally displaced from or above the first radiation point in a location not near the ears of any listener. Additionally, the devices do not have to include chambers 10 and 12, as will be shown below.

Figure 4B:
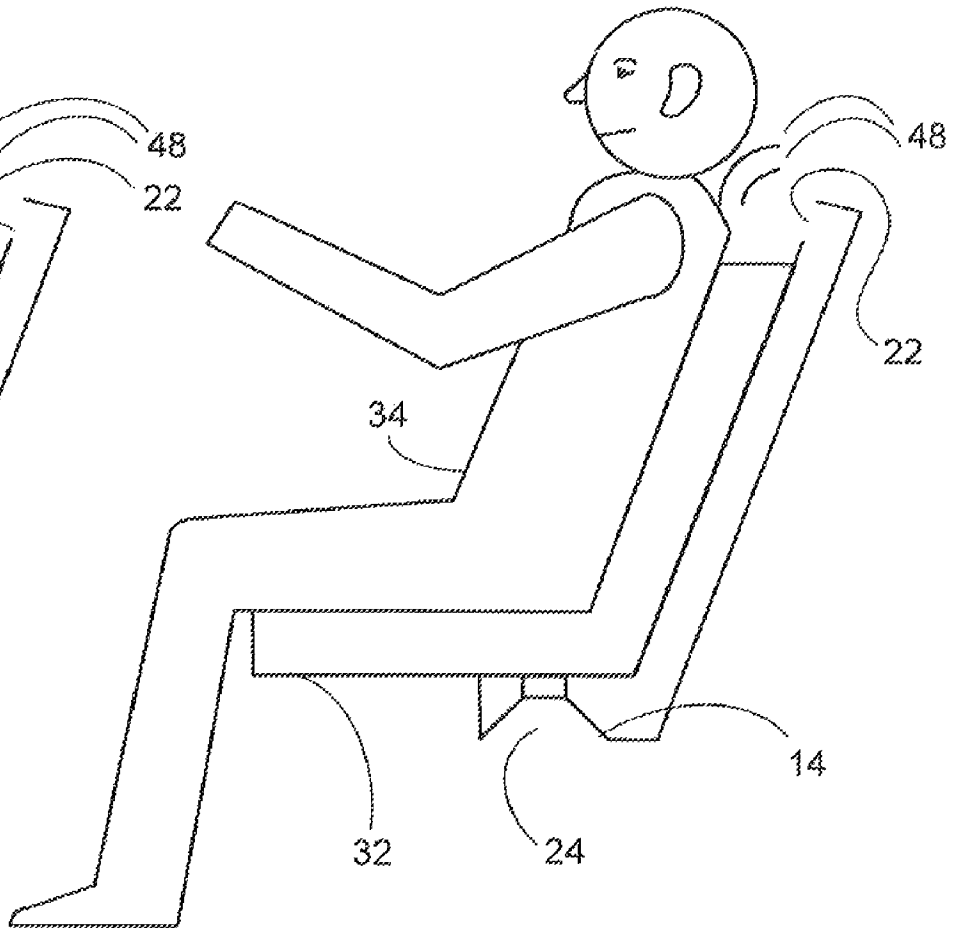
FIGS. 4A-4D are diagrammatic views of alternate implementations of a bass loudspeaker mounted to a seating device.
Figure 4A:
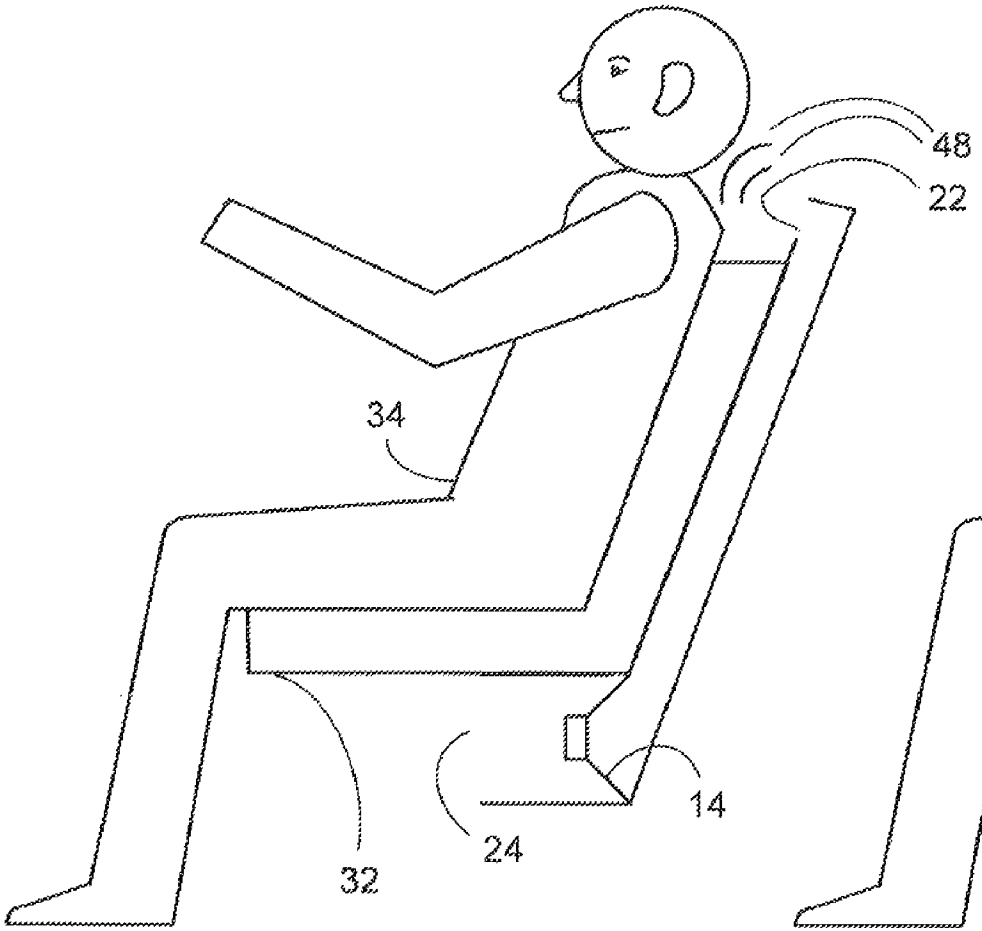
Figure 4C:
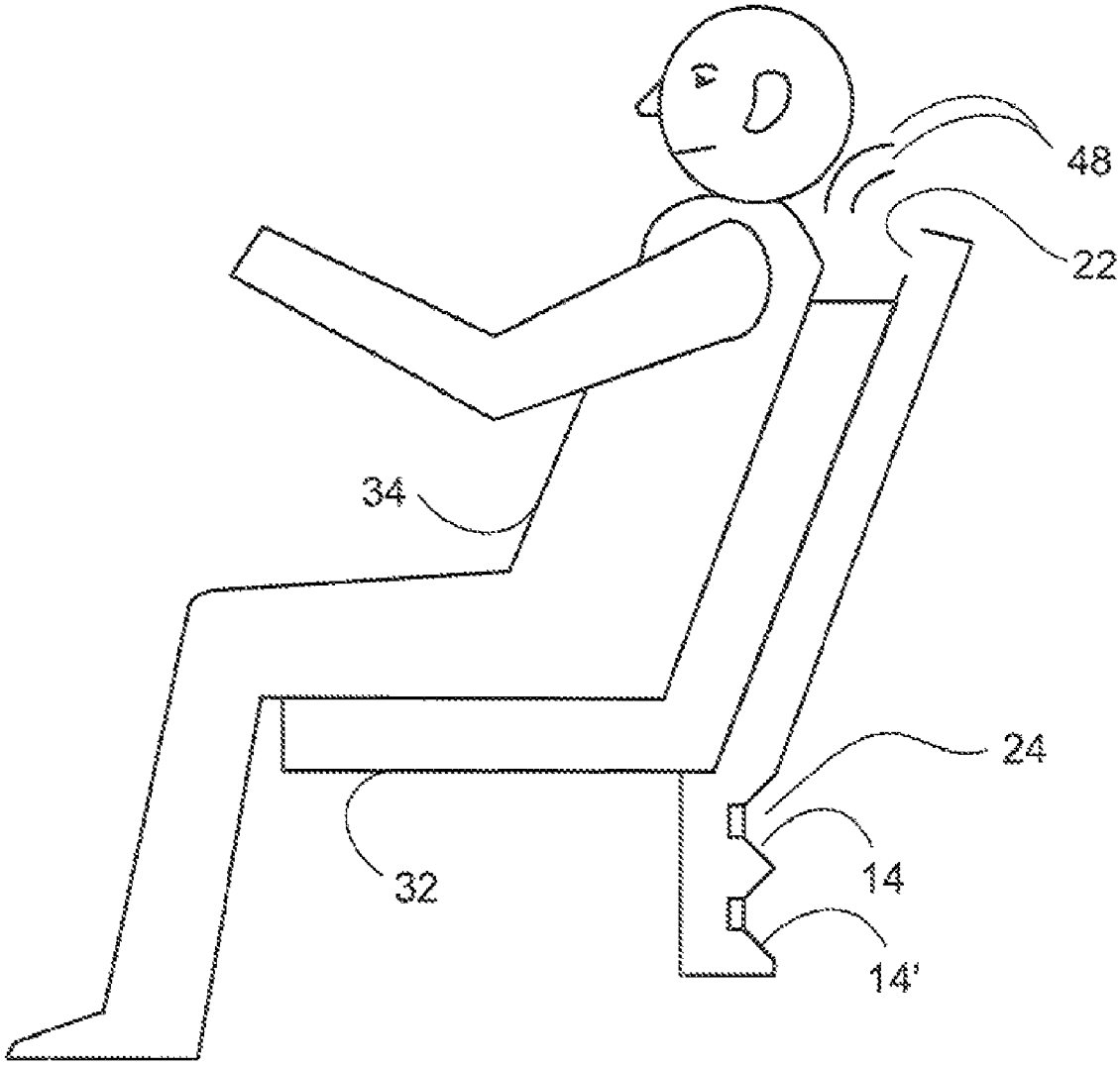

FIGS. 4A-4D show alternate implementations of the loudspeaker device of FIGS. 1-3. In the implementation of FIGS. 4A-4C, the transducer 14 is positioned below the seat 32 and is positioned so that lower exit 24 is substantially closer to the transducer than upper exit 22. In the implementation of FIG. 4B, the transducer 14 is positioned so that the motor structure is near the seat bottom and so that the axis of motion is substantially perpendicular to the seat bottom. In the implementation of FIG. 4C, there is a second transducer 14' and transducers 14 and 14' are positioned to radiate directly to the environment, and not through an enclosure. For protection an acoustically transparent material, such as a grille, scrim or a grate, may be placed in front of the transducer.

Figure 4D:
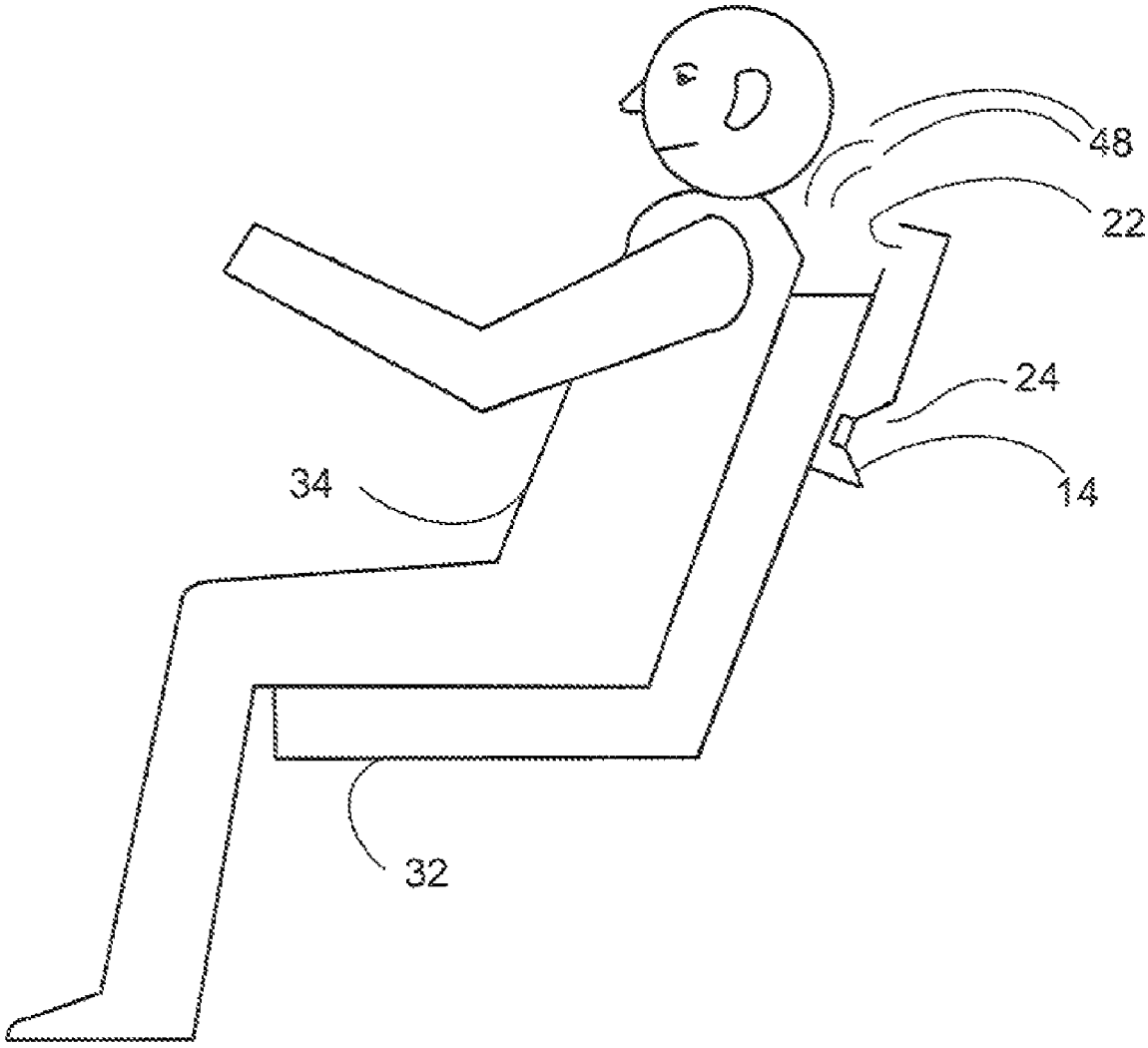

The implementation of FIG. 4D illustrates the principle that the lower exit 24 does not need to be far removed from the upper exit 22, so long as the upper exit 22 is significantly closer to the head of the seated person 34 than is the lower exit 24, and so far as the lower exit 24 is significantly farther from the head of a listener than is the upper exit 22.

Like the previous implementations, at locations for which the distance from the device is similar to or large relative to the distance between the exits, the distance from the two radiation points is relatively equal and the magnitudes of the pressure waves from radiation points 22 and 24 are approximately equal. The manner in which the contributions from the two exits combine is determined principally by the relative phase of the pressure waves at the observation point. At some frequencies, the pressure waves may have some phase difference and destructively interfere, resulting in reduced amplitude.

At points that are significantly closer to one of the two radiation points, the magnitudes of the pressure waves from the two radiation points are not equal, and the sound pressure level is determined principally by the sound pressure level from the nearer radiation point. So in the vicinity of the user's head, the sound pressure level is determined principally by the radiation from upper exit 22 and in the vicinity under the seat (where there is unlikely to be a listener) the sound pressure level is determined principally by the radiation from lower exit 24.

The implementations of FIGS. 4A-4C permit the enclosure to be thinner, so these implementations are particularly suited for situations in which it is important for the device to be as thin as possible. The implementation of FIG. 4A is suited for situations in which the tactile stimulation from the vibration of the transducer is not important, while the implementation of FIG. 4B is suited for situations in which the tactile stimulation from the vibration of the transducer is important.

Figures 5, 6:
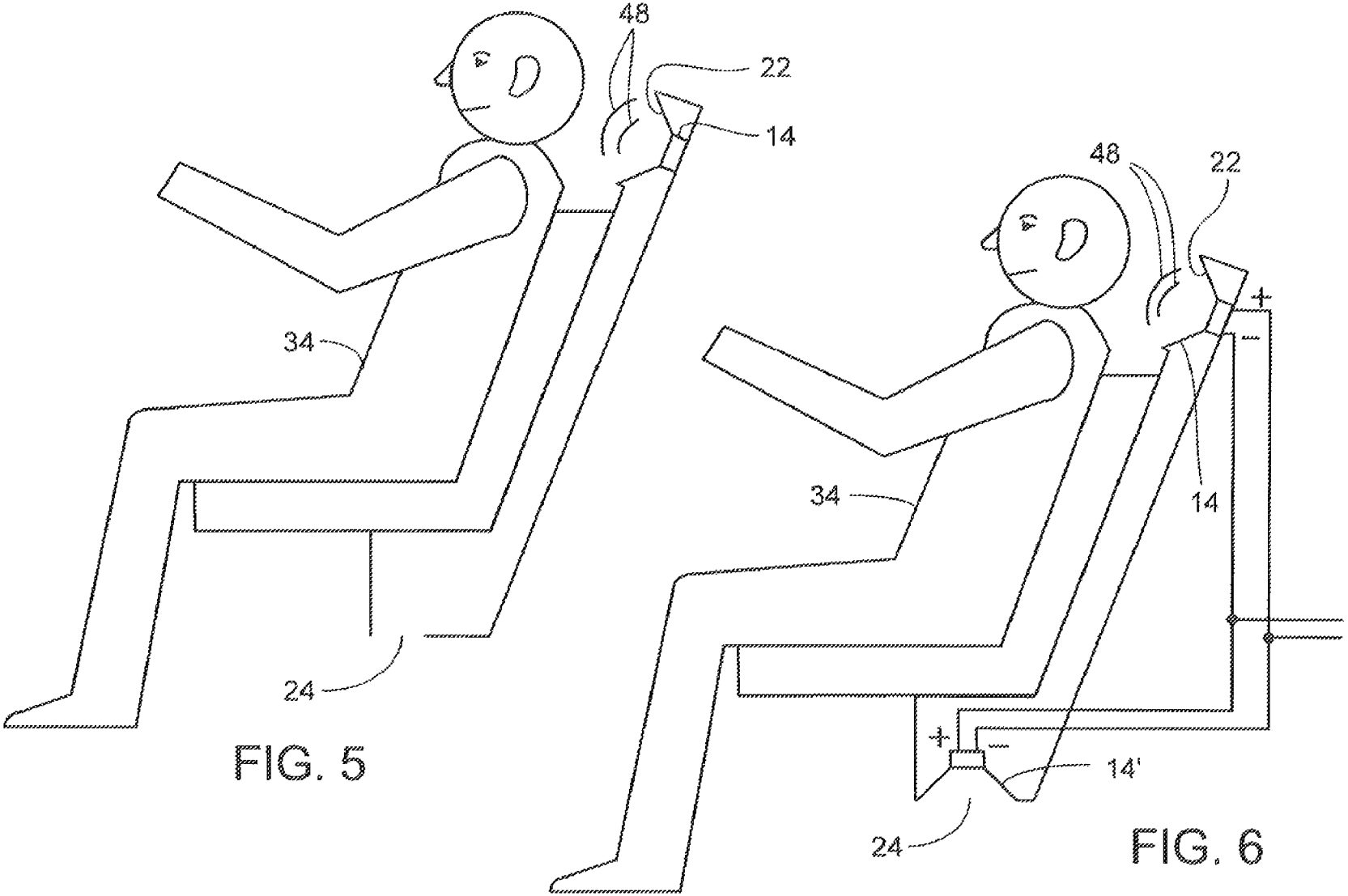
FIG. 5 is a diagrammatic view of another alternate implementation of a bass loudspeaker mounted to a seating device
FIG. 6 is a diagrammatic view of yet another alternate implementation of a bass loudspeaker mounted to a seating device.

FIG. 5 shows another implementation of the loudspeaker device. In FIG. 5, the transducer 14 is positioned so that the transducer radiates directly toward the user's head, and the lower exit 24 is near the floor.

In implementations in which the transducer is significantly closer to one of the exits than to the other exit, the sound field may differ from implementations in which the transducer is substantially equidistant from the two exits, but the different implementations exhibit the same behavior; that is, the sound pressure level close to the exits is determined principally by radiation from the nearby exit, while at locations at a distance from the device that is large relative to the distance between the two exits, the sound pressure level is determined by the phase relationships of the pressure waves from the two exits.

Additionally, in implementations in which the distance between the transducer and an exit approaches or exceeds one-fourth of the wavelength corresponding to the frequency of the radiated sound, the enclosure may exhibit waveguide behavior and have resonances at certain frequencies. In such situations, it may be desirable to electronically modify (for example by equalizing) the audio signal or to acoustically modify (for example by damping) the radiation to lessen the effect of frequency response aberrations caused by the resonances.

FIG. 6 shows yet another implementation of the device of FIGS. 1-3. In the implementation of FIG. 6, the two radiation points 22 and 24 are implemented as two transducers 14 and 14', one positioned near the head of the user and the other positioned near the bottom of the seat. The device of FIG. 6 is constructed and arranged so that it can be modeled as in FIG. 2B. This can be done in a number of ways, for example by physically reversing the transducers; by reversing the polarity of the wiring connections; by using transducers with voice coils wound in different directions; by reversing the poles of the transducer magnets; or by signal processing. Any combination of signal processing and placement and configuration that can be modeled as in FIG. 2B for radiating bass frequencies is included within the scope of this specification.

Figure 7:
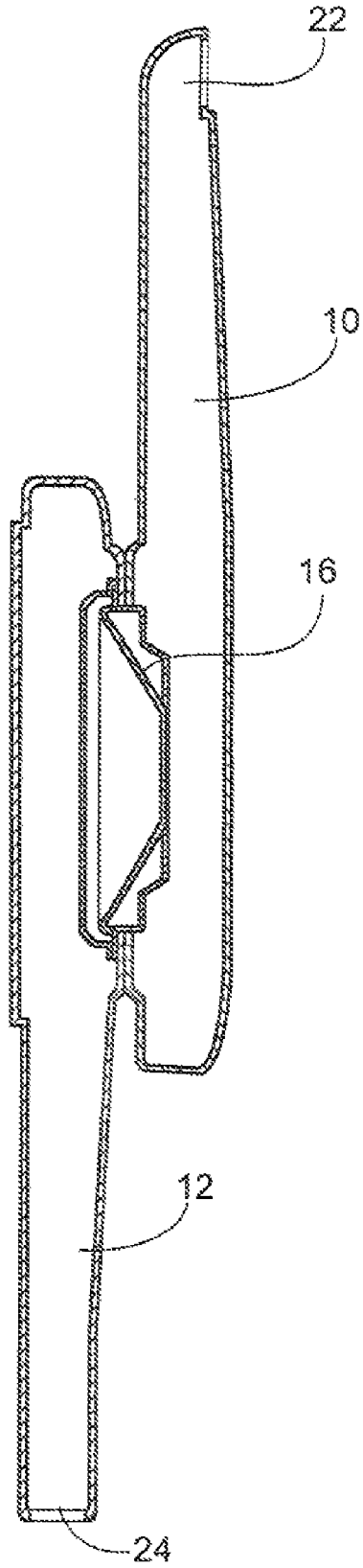
FIG. 7 is a cross sectional view of a practical implementation of the bass loudspeaker device of FIGS. 1-3.
Figure 8:
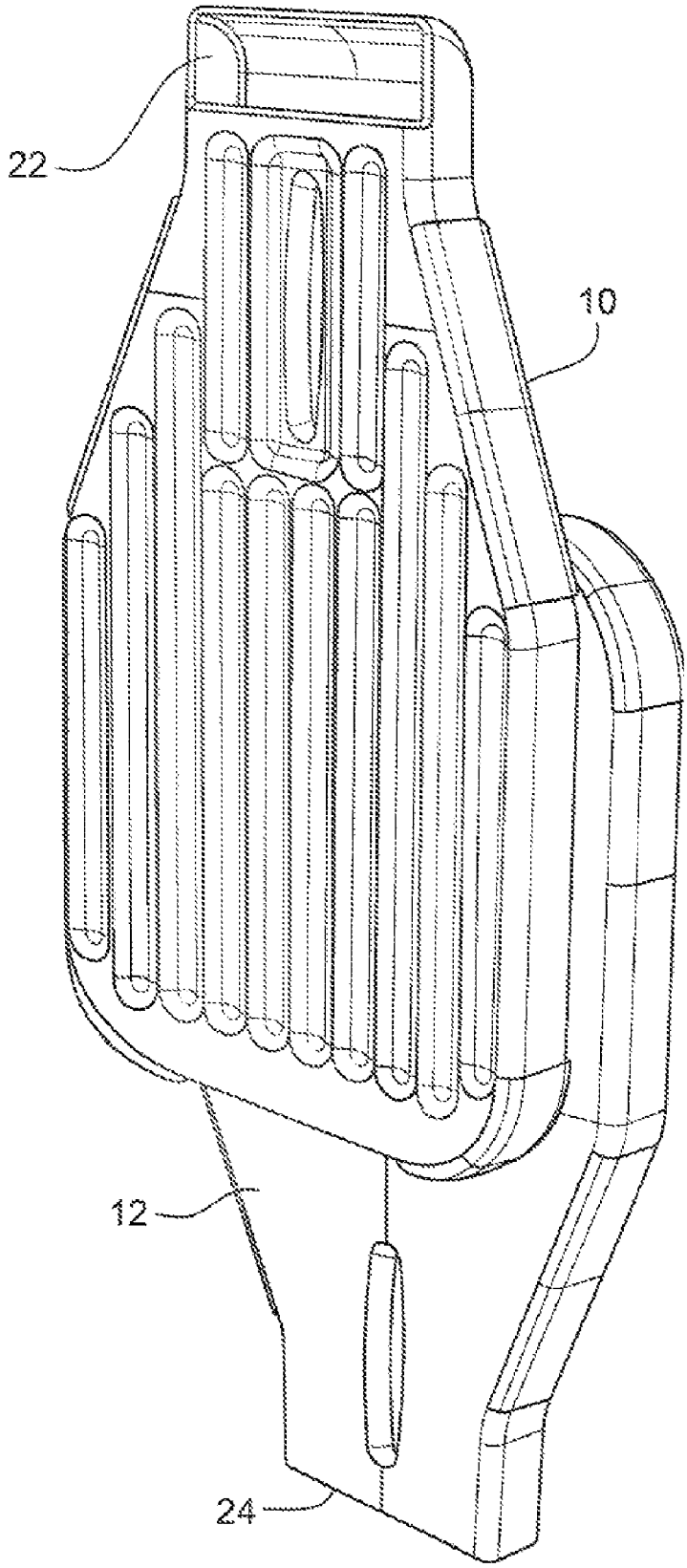
FIG. 8 is an isometric view of the practical implementation of the bass loudspeaker device of FIG. 7.

FIGS. 7 and 8 are a cross-section and an isometric view, respectively, of a practical embodiment of the devices of FIGS. 1-3. Elements of FIGS. 7 and 8 that correspond to elements of FIGS. 1-3 are identified with like reference numbers.

Figure 9:
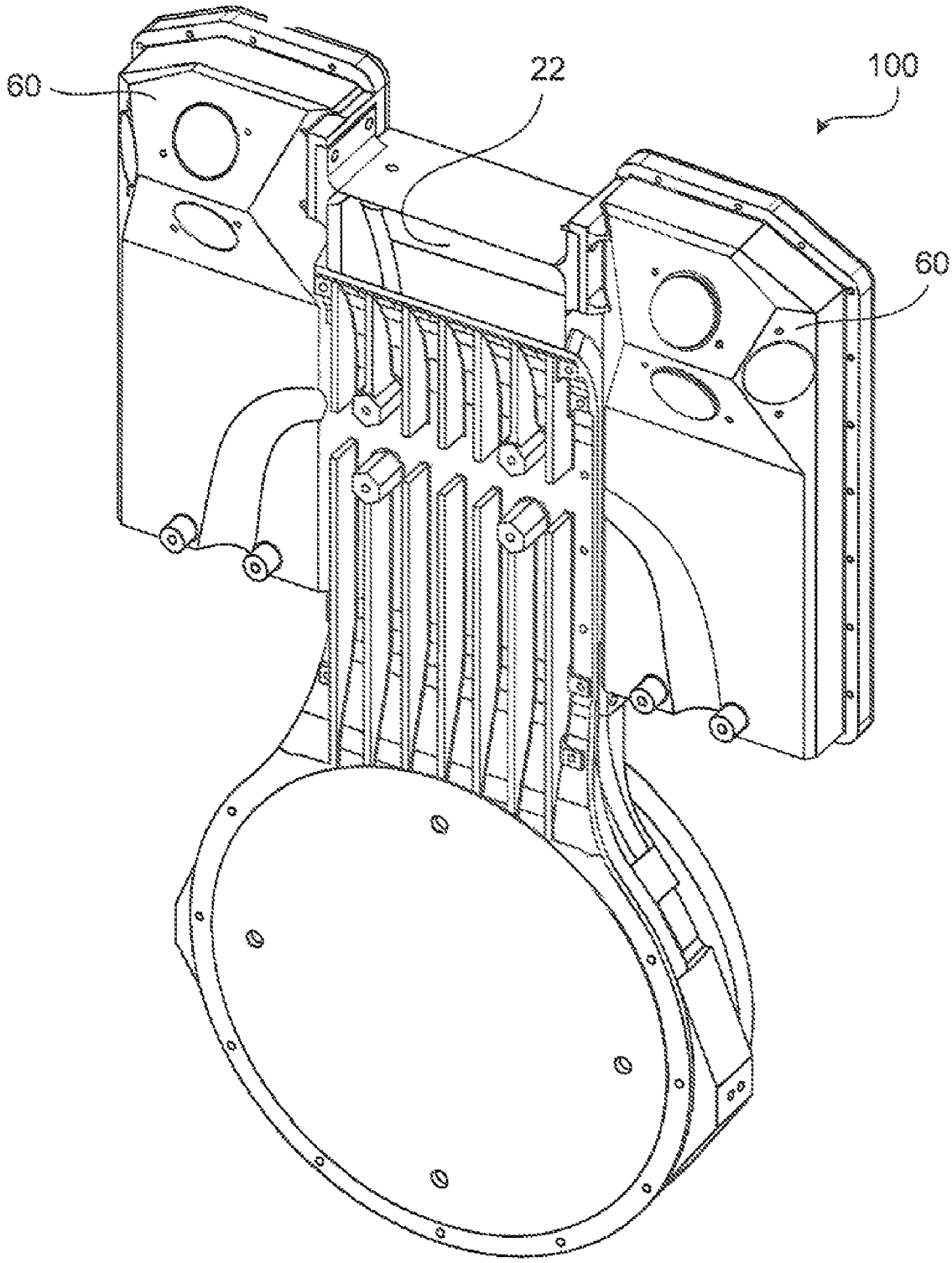
FIG. 9 is an isometric view of the practical implementation of the bass loudspeaker device of FIGS. 7 and 8, with some additional elements.

FIG. 9 shows a practical embodiment of the device of FIG. 4D with additional elements. Full range loudspeaker 100 includes a device 1 similar to the devices of FIGS. 1-9 to radiate bass range frequencies. In addition, a full range loudspeaker 100 includes directional arrays 60 that are positioned so that they radiate frequencies above the bass range directionally toward an occupant of the seat.

A device according to FIG. 9 is advantageous because a full range loudspeaker can be mounted to or integrated into a seating device to provide full range audio to the occupant of the seat without audibly interfering with the activities of other nearby persons. The audio signals to the directional arrays 60 can be processed to provide directional cues to the occupant of the seat while the bass loudspeaker device 1 provides tactile stimulation and aroma. Combined with a video device, the full range loudspeaker 100 can provide an occupant of the seat with a realistic multi-sensory experience.

Figure 10A:
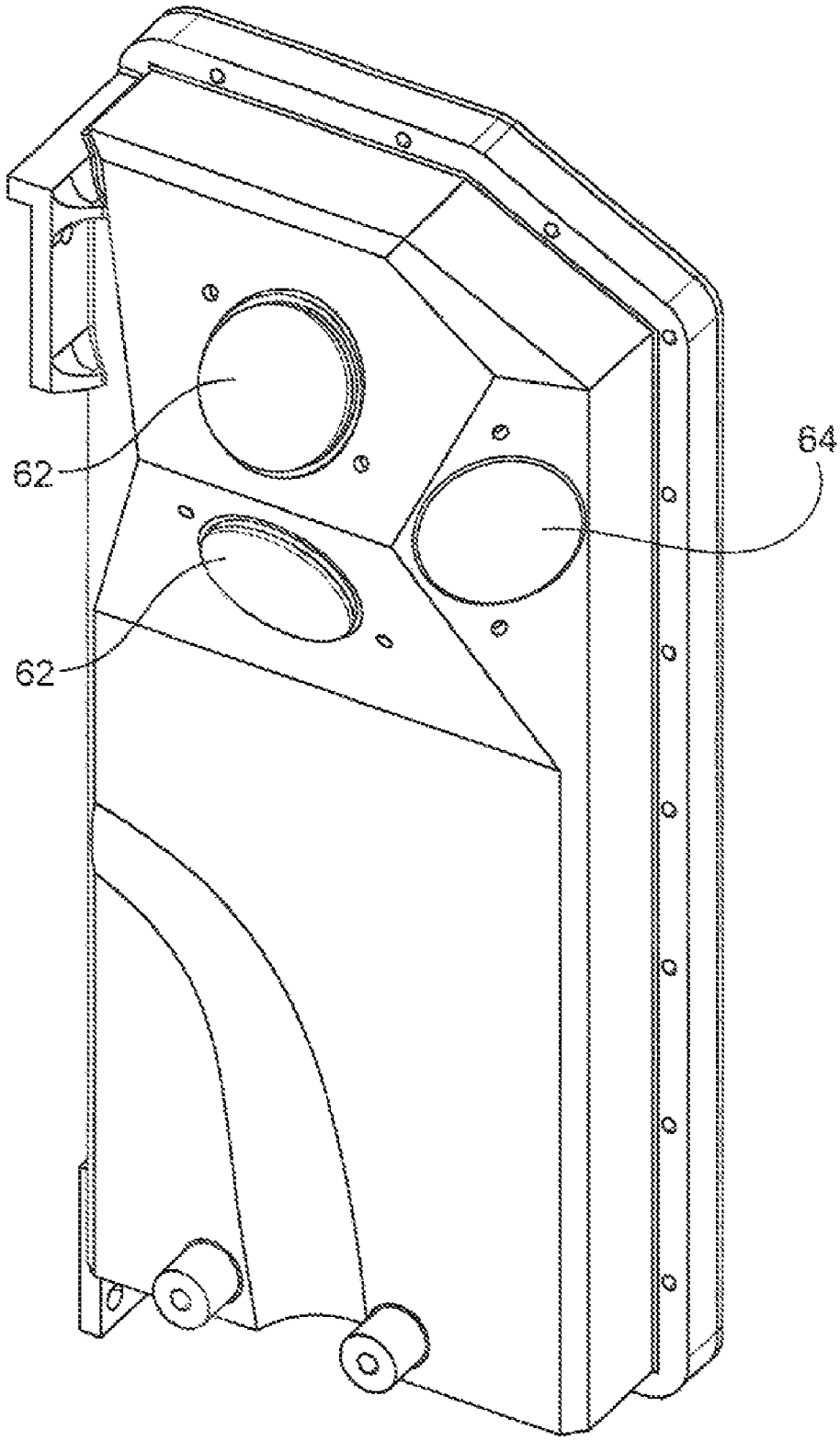
FIG. 10A is an isometric view of an element of FIG. 9.
Figure 10B:
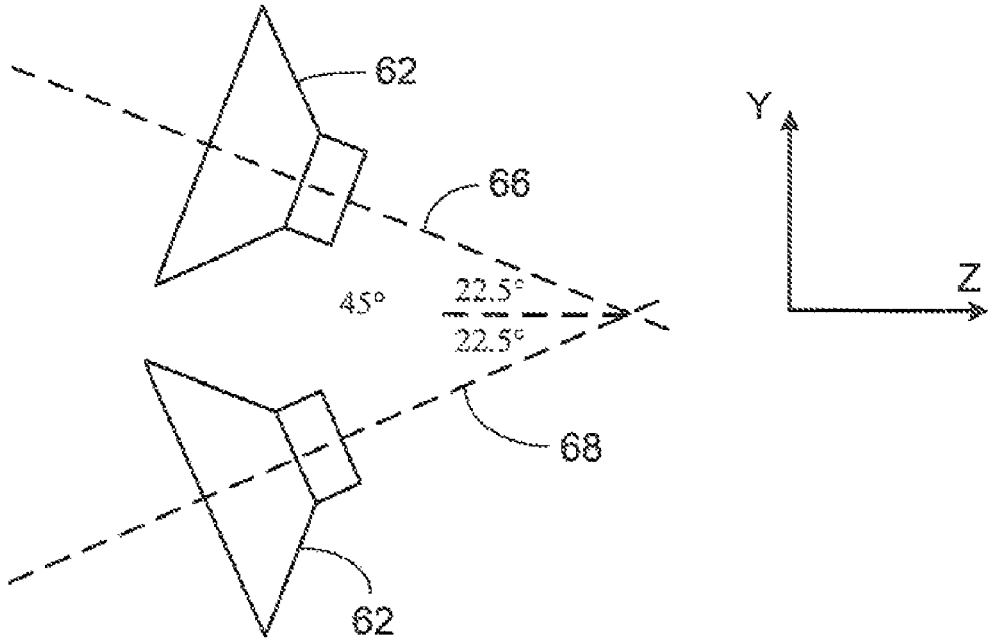
FIGS. 10B-10C are diagrammatic cross-sectional views of the device of FIG. 10A.
Figure 10C:
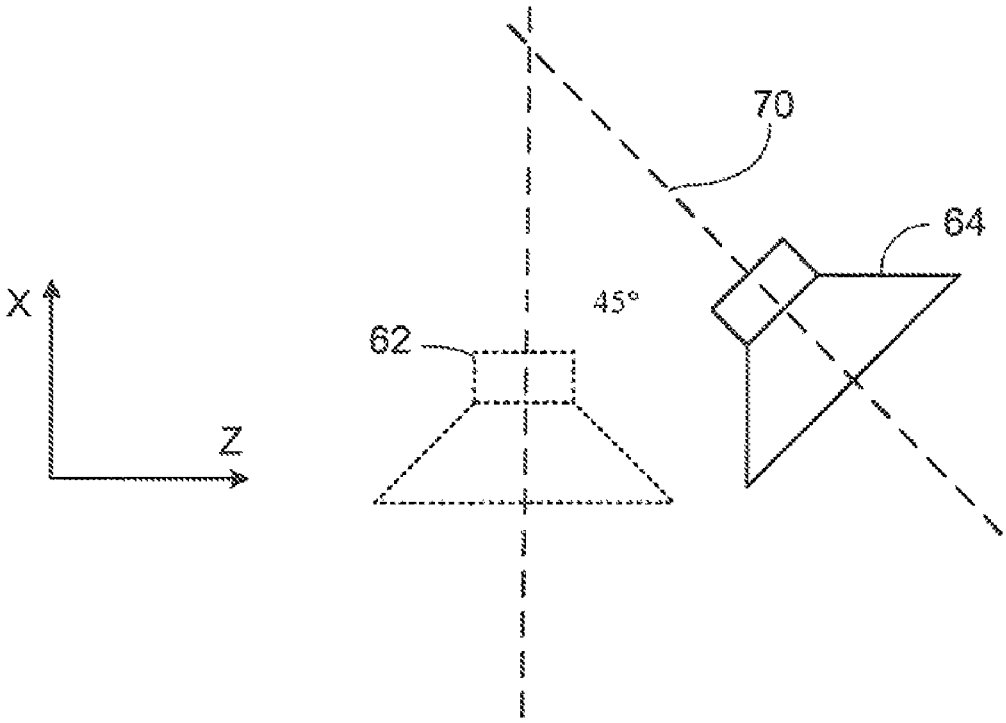

FIGS. 10A-10C show an array that is suitable for directional arrays 60. Other suitable directional arrays are described in Harry F. Olson, "*Gradient Loudspeaker," J. of the Audio Engineering Society*, March 1973, Volume 21, Number 2, in U.S. Pat. No. 5,587,048, and in U.S. Pat. No. 5,809,153. In the directional array 60 of FIGS. 10A-10C, two electroacoustical transducers 62 are positioned so that the axes 66 and 68 are at 22.5 degrees relative to the X-Z (horizontal) plane and 45 degrees relative to each other and the axis 70 of electroacoustical transducer 64 is positioned at 45 degrees relative to the Y-Z plane. Transducers 62 and 64 may constructed and arranged to radiate so that the direction toward the head of a person in the seating device is a high radiation direction so that the frequencies radiated by the directional array 60 can be heard by the occupant of the seat without audibly interfering with activities of other nearby persons. The directional arrays can also be used for other acoustic purposes, such as radiating directional cues, as described in U.S. patent application Ser. No. 10/309,395.

Numerous uses of and departures from the specific apparatus and techniques disclosed herein may be made without departing from the inventive concepts. Consequently, the invention is to be construed as embracing each and every novel feature and novel combination of features disclosed herein and limited only by the spirit and scope of the appended claims.

What is claimed is:

1. An acoustic device, comprising:

an acoustic enclosure;

a first electroacoustical transducer, mounted in the acoustic enclosure;

the acoustic device constructed and arranged so that first pressure waves are radiated from a first radiation point and second pressure waves are radiated from a second radiation point and so that the first pressure waves and the second pressure waves destructively interfere at observation points relatively equidistant from the first and second radiation points;

the acoustic device further constructed and arranged to be structurally combined with a seating device so that the first radiation point is relatively close to the head of an occupant of the seating device and so that the second radiation point is relatively far from the head of the occupant.

2. An acoustic device in accordance with claim 1, the electroacoustical transducing apparatus comprising a vibratile diaphragm having a first radiating surface and an opposed second radiating surface, the acoustic enclosure comprising a first chamber acoustically coupling the first radiating surface with the first radiation point, the electroacoustical transducing apparatus further comprising a second chamber acoustically coupling the second radiating surface with the second radiation point.

3. An acoustic device in accordance with claim 1, wherein the second radiation point is constructed and arranged to be below the head of an occupant of the seating device.

4. An acoustic device in accordance with claim 3, wherein the second radiation point is positioned near the bottom of the seat back.

5. An acoustic device in accordance with claim 1, the electroacoustical apparatus wherein the first transducing apparatus is operationally coupled to an audio signal source and positioned adjacent the first radiation point to radiate the first pressure waves, the acoustic device further comprising a second transducing apparatus operationally coupled to the audio signal source with reversed polarity relative to the first transducer, positioned adjacent the second radiation point to radiate the second pressure waves.

6. An acoustic device in accordance with claim 1, wherein the first transducing apparatus is constructed and arranged to radiate first pressure waves in the bass frequency range, the apparatus further comprising a directional loudspeaker, constructed and arranged to radiate sound in a non-bass frequency range.

7. An acoustic device in accordance with claim 6, wherein the first electroacoustical transducing apparatus is constructed and arranged to radiate bass frequencies and to not radiate frequencies above the bass frequency range and wherein the directional loudspeaker is constructed and arranged to radiate frequencies above the bass frequency range.

8. An acoustic device in accordance with claim 1, wherein the acoustic device is constructed and arranged to radiate bass frequencies and to not radiate frequencies above the bass frequency range.

9. An acoustic device in accordance with claim 1, wherein the electroacoustical transducing apparatus is constructed and arranged to radiate bass frequencies and to not radiate frequencies above the bass frequency range.

10. Apparatus comprising:

a seating device comprising a seat back;

a transducer constructed and arranged to be structurally combined with the seating device, the transducer comprising a pressure wave radiating diaphragm having a first surface and a second surface to radiate acoustic energy, the seating device further comprising an acoustic enclosure having a first radiation point and a second radiation point wherein the transducer is mounted in the acoustic enclosure so that pressure waves radiated by a first diaphragm surface leave the enclosure through the first radiation point and so that the pressure waves radiated by a second diaphragm surface leave the enclosure through the second radiation point.

11. Apparatus in accordance with claim 10, further comprising a directional loudspeaker, constructed and arranged to radiate sound so that the direction typically occupied by the head of an occupant of the seat is a high radiation direction.

12. A vehicle seat, comprising:

an acoustic apparatus comprising a first electroacoustical transducer in an acoustic enclosure for radiating acoustic energy into the acoustic enclosure;

the acoustic enclosure comprising a first exit point close to the position typically occupied by the head of an occupant of the vehicle seat for radiating acoustic energy of a first phase to the environment; and a second exit point removed from the position typically occupied by the head of an occupant of the vehicle seat for radiating acoustic energy of a second phase, opposite to the first phase, to the environment.

13. A vehicle seat according to claim 12, wherein the first electroacoustical transducer is for radiating acoustic energy in the bass frequency range, the acoustic apparatus further comprising a second electroacoustical transducer for radiating acoustic energy in the non-bass frequency range.

14. A vehicle seat according to claim 13, wherein the second electroacoustical transducer is a directional loudspeaker.

15. A vehicle seat according to claim 12, wherein the second exit is near the bottom of the vehicle seat.

16. A vehicle seat according to claim 12, wherein the electroacoustical transducer comprises an acoustic driver having a first surface acoustically coupled to the first exit and a second radiating surface acoustically coupled to the second exit.

17. A vehicle seat according to claim 12, wherein the electroacoustical transducer comprises:

a first acoustic driver acoustically coupled to the first exit to radiate acoustic energy of the first phase; and a second acoustic driver acoustically coupled to the second exit to radiate acoustic energy of the second phase.

* * * * *